US010329138B2

(12) United States Patent
Benetti

(10) Patent No.: US 10,329,138 B2
(45) Date of Patent: Jun. 25, 2019

(54) RIDING GIRTH

(71) Applicant: AMAHORSE TRADING S.r.l., San Giustino (IT)

(72) Inventor: Mauro Benetti, Brescia (IT)

(73) Assignee: AMAHORSE TRADING S.r.l., San Giustino (IT)

( * ) Notice: Subject to any disclaimer, the term of this patent is extended or adjusted under 35 U.S.C. 154(b) by 260 days.

(21) Appl. No.: 15/115,096

(22) PCT Filed: Jan. 26, 2015

(86) PCT No.: PCT/IB2015/050566
§ 371 (c)(1),
(2) Date: Jul. 28, 2016

(87) PCT Pub. No.: WO2015/114503
PCT Pub. Date: Aug. 6, 2015

(65) Prior Publication Data

US 2017/0001855 A1 Jan. 5, 2017

(30) Foreign Application Priority Data

Jan. 31, 2014 (IT) ..... BS2014U0003 U

(51) Int. Cl.
*B68C 1/14* (2006.01)

(52) U.S. Cl.
CPC ..... *B68C 1/14* (2013.01)

(58) Field of Classification Search
CPC ..... B68C 1/14; B68C 2001/142; B68C 2001/145; B68C 1/147; B68B 5/00;
(Continued)

(56) References Cited

U.S. PATENT DOCUMENTS 308,983 A * 12/1884 Pefley ..... B68C 1/14 54/23
934,304 A * 9/1909 Gooing ..... B68B 3/00 54/2

(Continued)

FOREIGN PATENT DOCUMENTS

DE 3308456 A1 * 9/1984 ..... A44B 11/24
DE 102006023994 A1 * 12/2007 ..... B68C 1/14

(Continued)

OTHER PUBLICATIONS

GFS Extra Bridles, http://www.gfsriding.co.uk/downloads/GFS-Riding-Catalogue-Part-2.pdf, published Oct. 11, 2010, accessed Jul. 27, 2018.*

(Continued)

*Primary Examiner* — Kathleen I Alker
(74) *Attorney, Agent, or Firm* — Thomas|Horstemeyer, LLP

(57) ABSTRACT

The invention relates to a riding girth comprising a central portion (10) from which two lateral bands (12) extend suitable to encircle the chest of the horse up to the connection to the saddle. On the outer side of the central portion (10) a coupling element (14) is made for attaching the loop of a strap of the martingale, harness or other operating instrument. Said coupling element (14) comprises a base (16) and a plate-shaped elastic hook (18) which extends from said base (16) and which permits the insertion/extraction of the loop of the strap into and from the coupling element thanks to the elastic lifting of an end portion thereof relative to the base (16).

15 Claims, 5 Drawing Sheets

(58) Field of Classification Search
CPC ..... B68B 99/00; B68B 1/00; A01K 27/00; A01K 27/001; A01K 27/002; A01K 27/005; Y10T 403/599; Y10T 403/60; Y10T 403/608; Y10T 403/1616; Y10T 403/1624; Y10T 24/1394; A45F 5/021
See application file for complete search history.

(56) References Cited

U.S. PATENT DOCUMENTS 1,632,368 A * 6/1927 Colton ..... B68B 5/00 54/56
3,672,123 A * 6/1972 Dykman ..... B68C 1/14 54/2
3,805,491 A * 4/1974 Deal ..... B68C 1/14 54/23
3,828,521 A * 8/1974 Dulaney ..... B68C 1/14 54/23
4,414,790 A * 11/1983 Mitchell ..... B68B 3/00 54/2
4,434,604 A * 3/1984 Bird ..... B68C 1/14 54/23
4,570,424 A * 2/1986 Simpson ..... B68C 1/14 54/23
5,031,387 A * 7/1991 Rider ..... B68C 1/14 54/23
5,426,924 A * 6/1995 Harty ..... B68C 1/14 54/23
5,503,894 A * 4/1996 Brown ..... B68C 1/14 119/792
5,768,864 A * 6/1998 Chang ..... B68C 1/14 54/23
5,946,892 A * 9/1999 Siddoway ..... B68C 1/14 54/23
6,058,685 A * 5/2000 Wotring ..... A44B 11/14 24/170
6,220,003 B1 * 4/2001 Hung ..... B68C 1/14 54/23
6,389,784 B1 * 5/2002 Siddoway ..... B68C 1/14 54/23
6,438,808 B1 * 8/2002 Kung ..... A45F 5/02 24/3.11
6,993,893 B2 * 2/2006 Siddoway ..... B68C 1/14 54/23
8,424,277 B2 * 4/2013 Koller ..... B68C 1/14 54/23
2004/0093698 A1 * 5/2004 Herman ..... A45F 5/02 24/3.12
2008/0104801 A1 * 5/2008 Yeh ..... A45F 5/02 24/3.12
2008/0104802 A1 * 5/2008 Vermillion ..... A45F 5/02 24/3.12
2008/0184678 A1 * 8/2008 Chang ..... A01K 13/006 54/65
2008/0237282 A1 * 10/2008 Sin ..... A45F 5/02 224/197
2016/0272479 A1 * 9/2016 Gerdes ..... B68C 1/14

FOREIGN PATENT DOCUMENTS

FR 2915982 A3 * 11/2008 ..... B68C 1/14
GB 2 376 620 A 12/2002
GB 2488030 A * 8/2012 ..... B68C 1/14
NL 1005316 C1 * 8/1998 ..... B68C 1/14

OTHER PUBLICATIONS

Krysty's Embroideries, http://www.kristys-embroideries.com/leatherwear.htm, published Jun. 3, 2008, accessed Jul. 27, 2018.*
Machine translation of DE 102006023994 to Alt, published Dec. 2007.*
Machine translation of FR 2915982 to Wozniak, published Nov. 2008.*
German Uniforms and Equipment: Y-Belt, http://www.mp44.nl/equipment/y_belt.htm, published Jan. 6, 2007, accessed Aug. 2, 2018.*
International Search Report for PCT/IB2015/050566 dated Apr. 30, 2015.
Translation of the Abstract for GB 2 376 620 published Dec. 24, 2002.

* cited by examiner

RIDING GIRTH

CROSS-REFERENCE TO RELATED APPLICATION

This application is the 35 U.S.C. § 371 national stage application of PCT Application No. PCT/162015/050566, filed Jan. 26, 2015, where the PCT claims priority to and the benefit of, IT Patent Application No. BS2014A000003, filed Jan. 31, 2014, both of which are herein incorporated by reference in their entirety.

The present invention relates to a riding girth.

As it is known, the girth is a harness used for riding, which has the purpose of fixing the saddle on the horse. It surrounds the chest of the animal, and connects to the attachments of the saddle.

Most of the currently used girths have in the central part a ring, a snap hook or a strap fitted with a buckle for connecting to the loop of the fastening strap to the martingale, harness, or to other fittings.

All these coupling systems are dangerous because when jumping the horseshoe may catch it with its rear part, where a steel crampon is usually inserted in the ring, hook, or strap of the girth. Such drawback is very dangerous and in most cases produces a disastrous fall of the horse and rider.

Therefore, the object of the present invention is to propose a girth able to overcome such a drawback.

A further purpose of the present invention is to provide a girth which is particularly comfortable for the horse.

The technical characteristics of the invention according to the aforesaid aims can be seen clearly from the contents of the following claims and the advantages of the same will be more clearly comprehensible from the detailed description below, made with reference to the attached drawings, showing one or more embodiments by way of non-limiting examples, wherein:

FIG. 1 is a view of the outside of the girth according to the invention, in a first embodiment;

FIG. 1*a* is an enlarged view of the central portion of the girth in FIG. 1;

Figure 1:
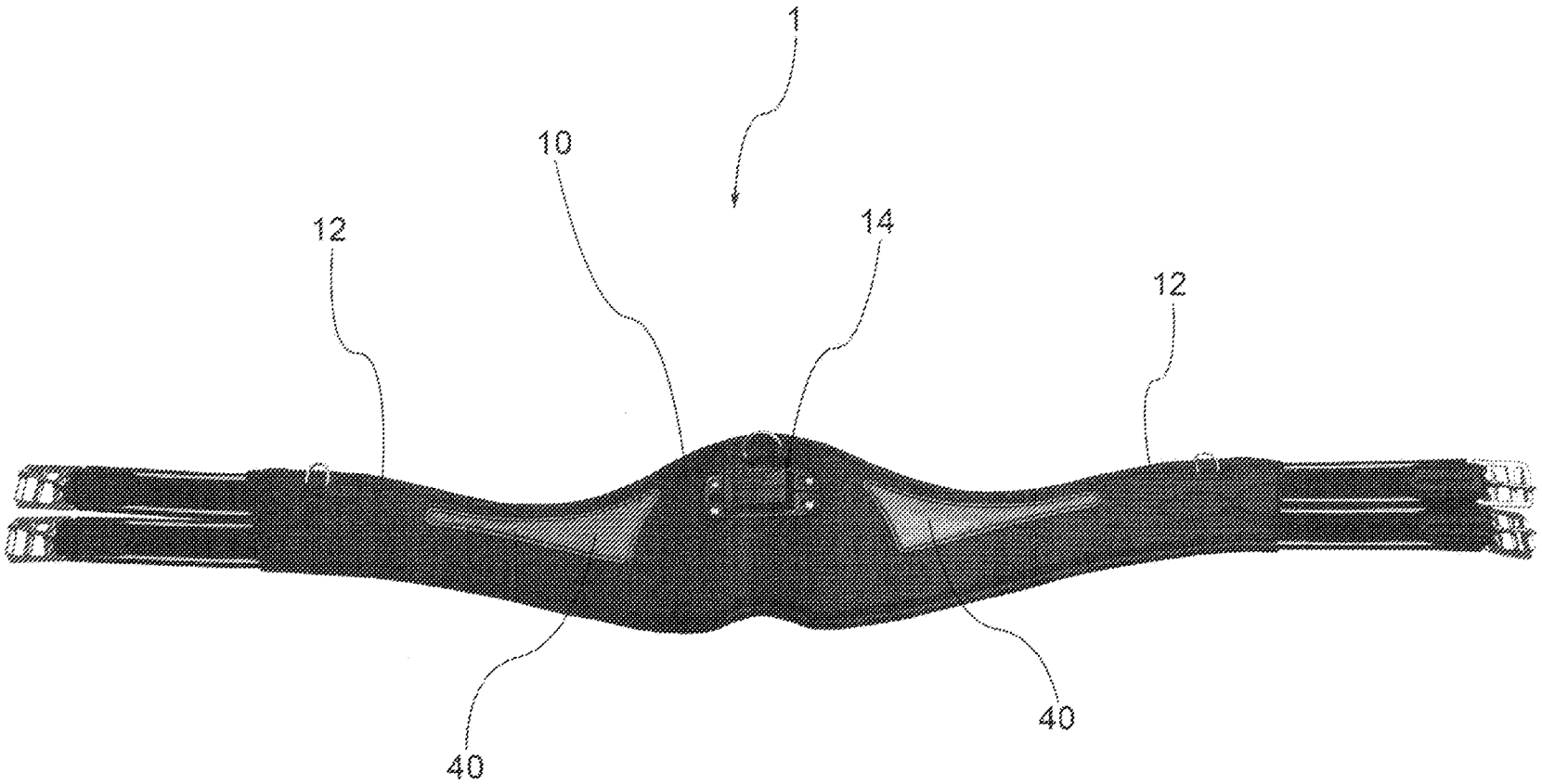

With reference to the appended drawings reference numeral 1; 1' globally denotes a girth according to the present invention.

The girth 1; 1' comprises a central portion 10 from which two lateral bands 12 extend suitable to encircle the chest of the horse up to the connection to the saddle.

On the outer side of the central portion 10 a coupling element 14 is made for attaching to the loop of a strap of the martingale, harness or other operating instrument. Said coupling element 14 comprises a base 16 and a plate-shaped spring hook 18 which extends from said base 16 and which permits the insertion/extraction of the loop of the strap into and from the coupling element thanks to the elastic lifting of an end portion thereof relative to the base 16.

Figure 1A:
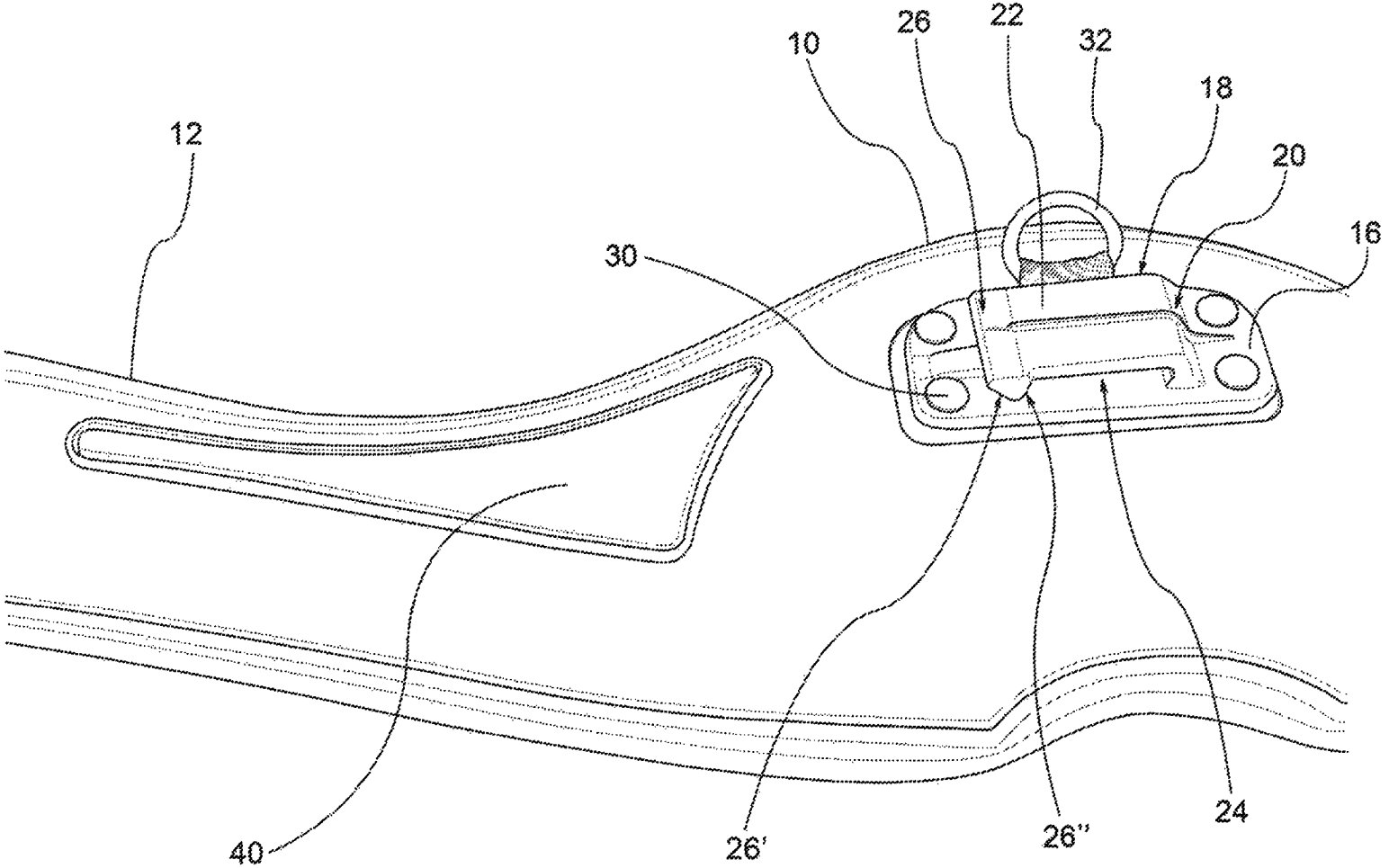

In a preferred embodiment, illustrated in detail in FIG. 1*a*, the plate-shaped spring hook 18 has a proximal portion 20 which rises from the base 16, an elongated intermediate portion 22, which extends substantially parallel to the base 16 or slightly inclined towards said base 16, so as to form with the base a lumen 24 for the passage of the loop of the strap to be coupled, and a distal portion 26 adjacent to the base 16, so as to laterally close the lumen 24.

The lumen 24 has a width slightly greater than the width of the strap to be coupled and a height from the base slightly greater than the thickness of the strap. The coupling element 14 is thus flattened towards the base 16.

Preferably, the distal portion 26 is shaped so as to act as a guide for the insertion of the loop of the strap into the hook by lifting the plate-shaped spring hook 18 and at the same time to prevent an accidental release of the strap from the coupling element. For example, said distal portion 26 forms a tooth defined by an inclined plane 26' facing outwards and acting as a guide and by an inner stop wall 26".

The proximal portion 20 is made in such a way as to give the spring hook 18 sufficient flexibility to permit a lifting of said hook 18 for the insertion and lateral extraction of the loop of the strap and at the same time a stiffness such as to prevent an accidental lifting of the hook.

In one embodiment, the coupling element 14 is made in a single body. Preferably, said coupling element is made of plastic material, for example filled Nylon, by injection moulding.

In one embodiment, the base 16 is attached to the central portion 10 of the girth 1, for example by screws or rivets 30.

In one embodiment, a ring 32 is also fixed to the central portion 10 of the girth 1; 1', opposite the lumen 24 of the coupling element 14, suitable to be crossed by the loop of the coupled strap to keep the loop of the strap even more adherent to the girth 1; 1'.

The coupling element described above, thanks to its particularly flat shape, dramatically reduces the risk of accidentally spearing the crampon of the horseshoe.

Furthermore, such a coupling element is also advantageous for the user, as it allows the attachment of the harness, martingale and any operating instrument in a much simpler, faster manner and without taking off the saddle.

In one embodiment, outer paddings 40 are applied to the outer side of the girth 1, between the central portion 10 and the side bands 12 for example by over-moulding or stitching, which make the girth 1; 1' softer and more flexible where it bends to embrace the side of the chest of the horse. For example, said outer paddings 40 are of an elongated triangular shape.

Figure 2:
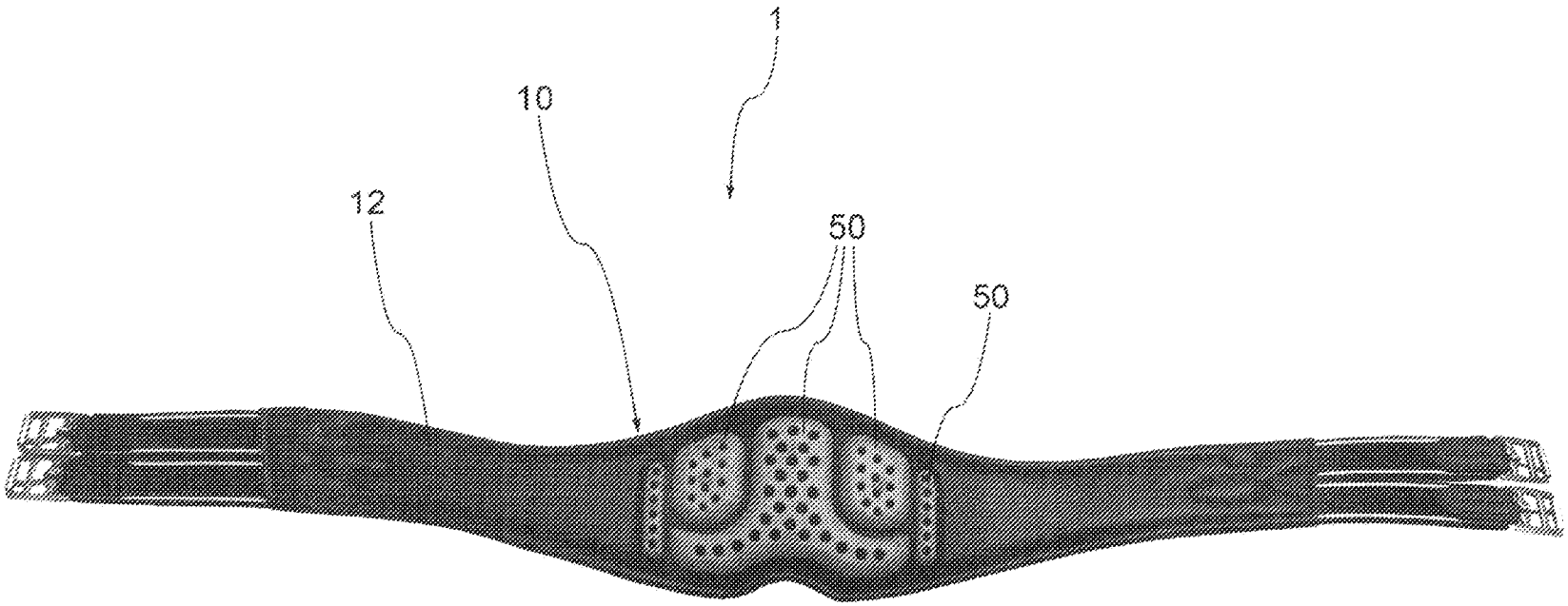
FIG. 2 is a view of the inside of the girth in FIG. 1.

FIG. 2 shows the inside of the girth 1, in a first embodiment relative to a reduced-width girth. On said inner side inner paddings 50 in thermoplastic gel are over-moulded. Said inner paddings 50 offer considerable comfort for the horse, reduce the risk of pinching the axillary area, and prevent blocking breathing. The combination of the outer paddings 40 and the inner paddings 50 allows the girth 1 to adapt better to the morphology of the horse by reducing the compression of the muscles so as to improve blood supply and oxygenation and thus permit better performance.

Figure 3:
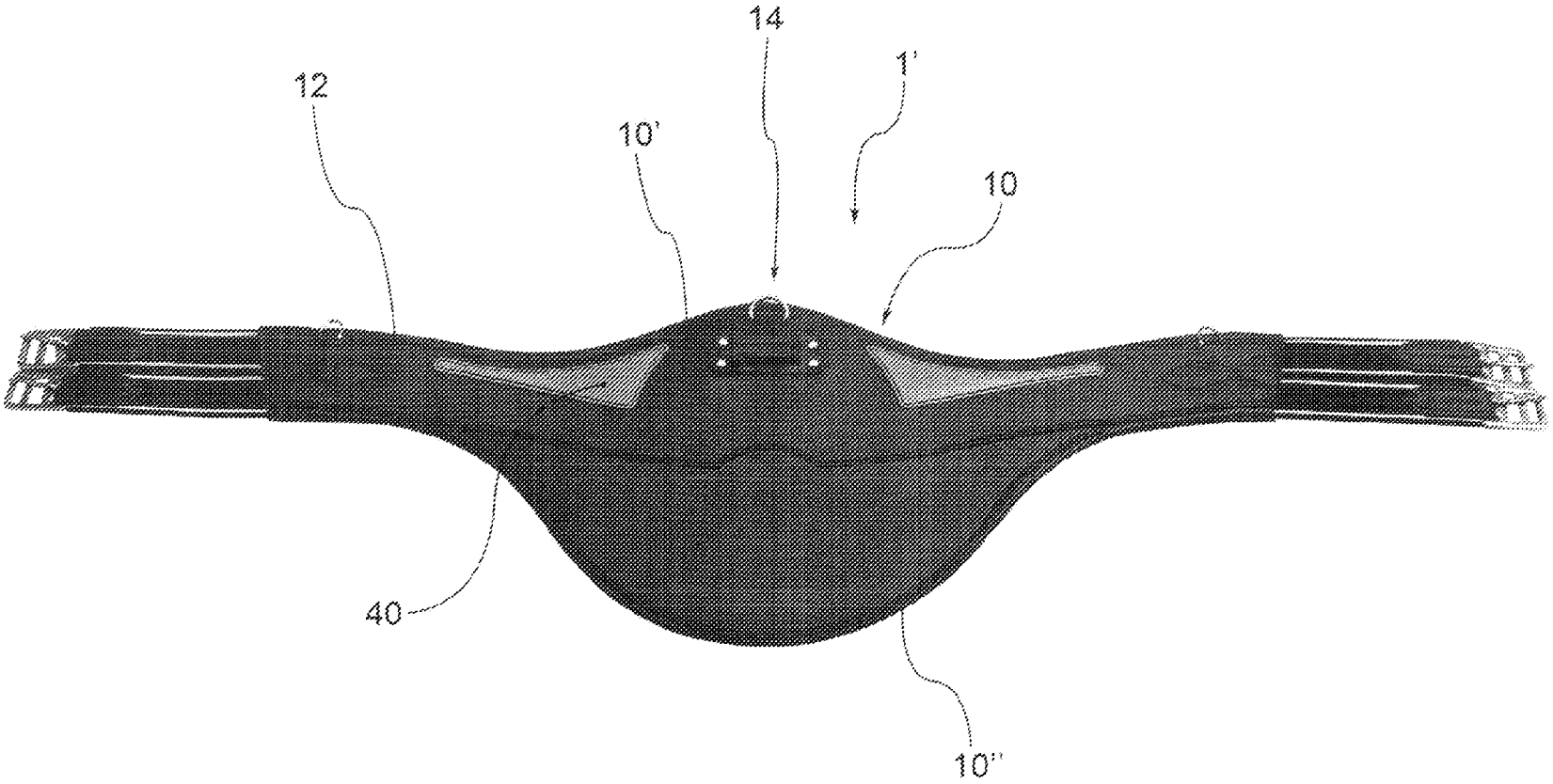
FIG. 3 is a view of the outside of the girth according to the invention, in a second embodiment.
Figure 4:
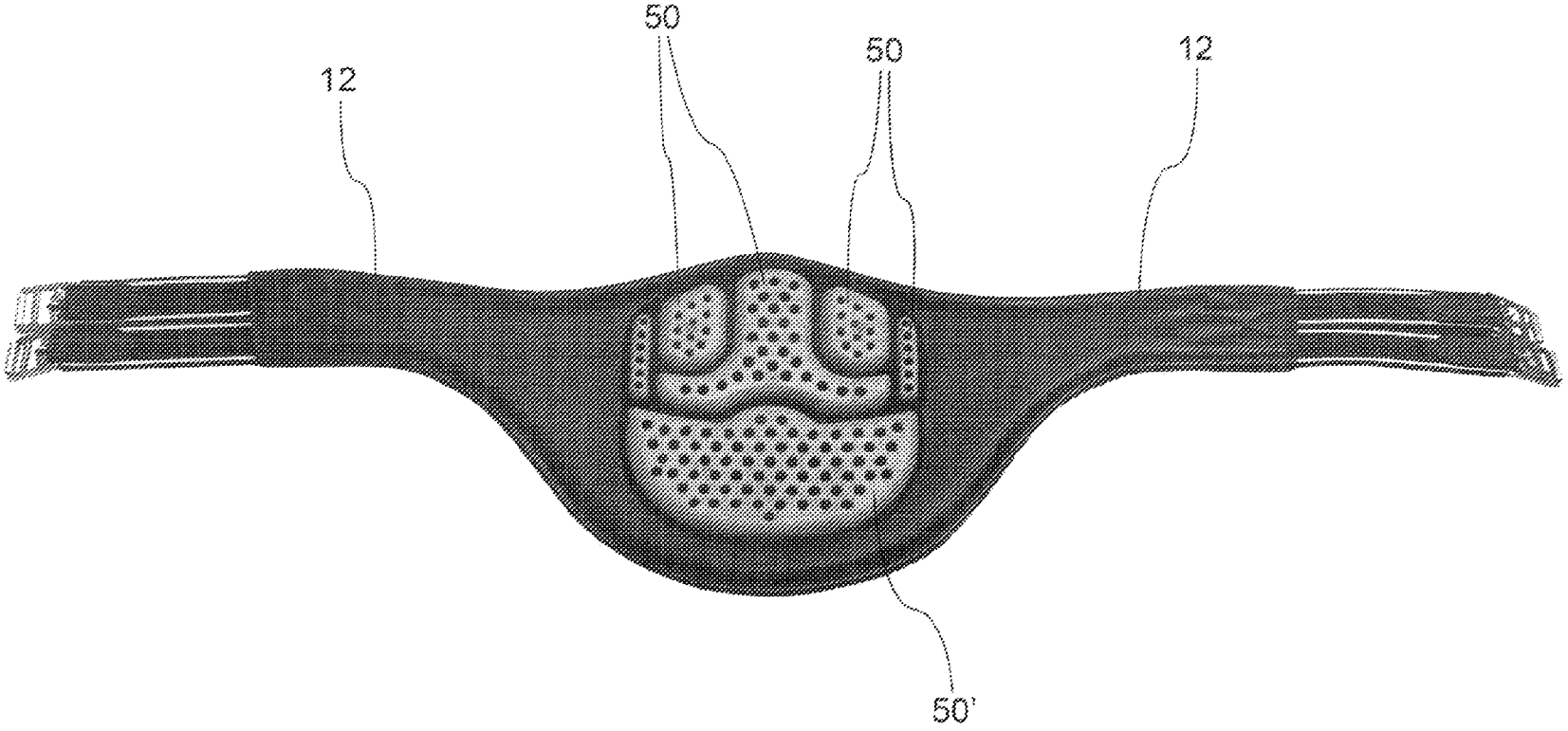
FIG. 4 is a view of the inside of the girth in FIG. 3.

FIGS. 3 and 4 show respectively the inner and outer side of the girth 1' in a second embodiment relative to a girth of increased width in the central portion 10. In this case, the central portion 10 comprises a front element 10' from which the side bands 12 extend and a rear extension 10". Said rear extension 10" is made separately from the front 10' and is connected to it, for example by stitching. This way, the same extension can be used for different sizes of the girth 1.

It is to be noted that the rear extension 10" is also provided, on the inner side, with an inner padding 50' in thermoplastic gel.

The invention thus conceived thereby achieves the intended objectives.

Obviously, its practical embodiments may assume forms and configurations different from those described while remaining within the sphere of protection of the invention.

Furthermore, all the parts may be replaced with technically equivalent parts and the dimensions, shapes and materials used may be varied as required.

The invention claimed is:

1. A riding girth comprising:

a central portion from which two lateral bands extend and are configured to encircle a chest of a horse and configured to connect a saddle, wherein the central portion has an outer side and an inner side, wherein the inner side is configured to come in contact with a girth region of a horse, and wherein the outer side is configured to face away from the horse;

and a coupling element, wherein the coupling element is coupled to the outer side of the central portion, wherein the coupling element is configured to attach a loop of a strap, wherein the coupling element comprises a base and a plate-shaped spring hook, wherein the base has first and second sides, the first side of the base being fixedly coupled to the outer side of the central portion, wherein the plate-shaped spring hook extends from the second side of the base, wherein an end of the coupling element is configured to elastically lift relative to the base to permit insertion and extraction of the loop of the strap in and out of the coupling element, wherein the plate-shaped spring hook comprises:

a proximal portion configured to rise from the base, an elongated intermediate portion that extends substantially parallel to the base or slightly inclined towards the base so as to form a lumen with the second side of the base, wherein the lumen is configured for the passage and coupling of the loop of the strap, and a distal portion adjacent to the base configured to laterally close the lumen.

2. The riding girth according to claim 1, wherein the strap is a strap of a martingale, a harness, or other operating instrument.

3. The riding girth according to claim 1, wherein the lumen has a width slightly greater than the width of the loop of the strap and a height as measured from the base, wherein the height is slightly greater than the thickness of the loop of the strap.

4. The riding girth according to claim 3, wherein the proximal portion is configured to give the spring hook sufficient flexibility to permit a lifting of the spring hook for the insertion and lateral extraction of the loop of the strap and at the same time have a stiffness such as to prevent an accidental lifting of the hook.

5. The riding girth according to claim 1, wherein the distal portion is shaped so as to act as a guide for the insertion of the loop of the strap into the hook by lifting the plate-shaped spring hook and at the same time to prevent an accidental release of the strap from the coupling element.

6. The riding girth according to claim 5, wherein the distal portion forms a tooth defined by an inclined plane facing outwards and forms a guide and by an inner stop wall.

7. The riding girth according to claim 1, wherein the coupling element is made in a single body.

8. The riding girth according to claim 7, wherein the coupling element is made of plastic.

9. The riding girth according to claim 1, wherein the base is attached to the central portion of the riding girth.

10. The riding girth according to claim 1, further comprising a ring, wherein the ring is attached to the central portion of the riding girth opposite the lumen of the coupling element, wherein the ring is configured to be crossed by the loop of the strap when in use and is further configured to keep the loop of the strap adherent to the riding girth.

11. The riding girth according to claim 1, further comprising outer paddings, wherein the outer paddings are coupled to the outer side of the girth between the central portion and the side bands, wherein the outer paddings are configured to increase the softness and flexibility of the riding girth in one or more regions of the riding girth that are configured to bend and come in contact with a region of the horse during use.

12. The riding girth according to claim 11, wherein the outer paddings are coupled to the outer side of the girth by over-moulding or stitching.

13. The riding girth according to claim 1, further comprising inner paddings, wherein the inner paddings are composed of a thermoplastic gel, and wherein the inner paddings are overmoulded on the inner side of the central portion.

14. The riding girth according to claim 1, wherein the central portion further comprises a front element from which the side bands extend and a rear extension, wherein the rear extension is made separately from the front element and is coupled to the front element.

15. The riding girth according to claim 14, wherein the rear extension is coupled to the front element by stitching.

* * * * *